United States Patent [19]

Dean et al.

[11] 4,114,340

[45] Sep. 19, 1978

[54] SELF-INTERLOCKING STANDING SEAM FOR A BUILDING PANEL

[75] Inventors: Charles Wallace Dean, Fort Myers; Gary Eugene Cummings, Cape Coral; Gary Lee Harvey, Fort Myers, all of Fla.

[73] Assignee: Dean Steel Buildings, Inc., Fort Myers, Fla.

[21] Appl. No.: 814,721

[22] Filed: Jul. 11, 1977

Related U.S. Application Data

[63] Continuation-in-part of Ser. No. 786,826, Apr. 12, 1977.

[51] Int. Cl.[2] ..... E04D 1/34; E04D 3/363

[52] U.S. Cl. ..... 52/520; 52/522; 52/545

[58] Field of Search ..... 52/520, 588, 392, 529, 52/493, 528, 542, 506, 276, 519, 277, 278, 394, 511, 522, 531, 539, 552, 545; 138/167, 168

[56] References Cited

U.S. PATENT DOCUMENTS

| | | | |
|---|---|---|---|
| 598,270 | 2/1898 | McCallum | 52/529 |
| 631,092 | 8/1899 | Reese | 52/528 X |
| 892,248 | 6/1908 | Garvin | 52/520 |
| 1,086,915 | 2/1914 | Hoffman | 52/531 |
| 1,715,008 | 5/1929 | Rose | 138/167 |
| 1,984,607 | 12/1934 | Twickler | 138/168 |
| 2,147,775 | 2/1939 | Miller | 138/167 |
| 2,522,097 | 9/1950 | Cookson | 52/522 X |
| 2,565,610 | 8/1951 | Kinghorn | 52/522 |
| 3,394,524 | 7/1968 | Howarth | 52/588 |
| 3,462,906 | 8/1969 | Schroyer | 52/588 X |
| 3,481,094 | 12/1969 | Taylor | 52/394 |
| 3,511,011 | 5/1970 | Strauss | 52/520 X |
| 3,606,718 | 9/1971 | Curran | 52/588 X |
| 3,898,783 | 8/1975 | Matlock et al. | 52/520 X |

FOREIGN PATENT DOCUMENTS

| | | | |
|---|---|---|---|
| 285,708 | 8/1968 | Australia | 52/536 |
| 89,858 | 10/1960 | Fed. Rep. of Germany | 52/528 |
| 872,817 | 7/1961 | United Kingdom | 52/522 |

*Primary Examiner*—Alfred C. Perham
*Attorney, Agent, or Firm*—Shoemaker and Mattare, Ltd.

[57] ABSTRACT

A self-interlocking standing seam for a building panel. The panel includes a male element on one lateral edge and a female element on the other lateral edge. The male element is wedged into a channel on the female element and is locked in place by a skirt on the female element. A hermaphroditic fastener element is interposed between the interlocked panels and is secured to a building element, such as a purlin.

9 Claims, 6 Drawing Figures

SELF-INTERLOCKING STANDING SEAM FOR A BUILDING PANEL

BACKGROUND OF THE INVENTION

The present application is a continuation-in-part of application Ser. No. 786,826, filed Apr. 12, 1977.

The present invention relates to building materials, and more particularly, to building panels.

Interlocking building panels are often used for a variety of purposes, such as for side walls or for roof installations. These panels should be amenable to shipping and storage, as well as to easy and quick assembly.

Presently known panels often have one or more drawbacks. For example, many panels require special machines for on-site installation thereof, others require fasteners such as clips to connect adjoining panels together, while still others do not nest for easy shipping and/or storage. Often, the fasteners used to fasten the panels to a main building structure are exposed and thus vitiate the aesthetic appearance of the assembled structure. It is also noted that machines used for in situ installation often mar the panels which also detracts from the appearance thereof. Some prior art panels use button-like elements on a male element to perform the function of locking adjacent panels together. If clips are used with these panels, those clips prevent the seam from being continuous and uninterrupted. These prior art panels further utilize but a single layer of panel material to protect the seam from environmental factors. Such interrupted and unprotected seams are susceptible to leaks and to corrosion caused by such leaks. Any corrosion may create an expansion action which may tend to unfasten the seam. Such expansion may also occur if the seam is deformed during assembly.

All of the above-discussed drawbacks tend to reduce the integrity of the panel seams, which is undesirable.

SUMMARY OF THE INVENTION

The panels embodying the teachings of the present invention are easily interlocked together and are easily stored and shipped.

Each panel comprises a male fastening element on one lateral edge and a female fastening element on the other lateral edge thereof. The female fastening element has a channel covered by a skirt portion and has a hook which is defined on one edge of the channel. The male fastening element has an extension member which is wedged between the skirt and the hook of the female fastening element and into the channel to interlock adjoining panels together. The skirt is formed of a naturally resilient material so that the skirt yields to permit the male extension element to be wedged into the channel, but will lock that element into the channel once it is so placed. A gripping element is fastened to the building main structure and has a hermaphroditic member on the top thereof which is wedged into the female element to be locked therein behind the channel-forming element thereof. The gripping element fastens the interlocked panels to the building, and does not interfere with that panel interlocking action.

The panels can be used on either side wall or roof installations and are interlocked by simply interfitting the male and female elements of adjoining panels together. The gripping element is inserted behind and above the female insertion area, and thus a continuous and uninterrupted full-length locking seam is formed. The gripping action is done from above the seam. No special machinery or other equipment is required to assemble a roof or side wall comprised of the building panels embodying the teachings of the present invention, and, in fact, installation can be done by hand. The easy installation of the panels contributes to expeditious building erection, thus resulting in many cost savings. Once installed, the panels have seams which are not as susceptible to corrosion damage as are prior art panel seams. Corrosion damage, and other environmentally caused damage, is countered in the panel seam of the present invention by the continuous and uninterrupted nature thereof and because it is not highly susceptible to expansion action. The panels can be interconnected without raising a possibility of damaging such panels, thereby contributing to the efficiency of panel installation.

The panels can have factory caulked side laps and require no clips or other such fasteners for the interlocking thereof. The fasteners attaching the panels to the building structure are hidden from view and thus do not detract from the overall appearance of the interlocked panels. Furthermore, there are no holes through exposed panels.

The panels are easily nested for storage and shipment, and the panels can be offered in a wide variety of sizes and colors. For example, widths of 60 inches and 24 inches can be offered, as well as a wide variety of prepainted colors.

OBJECTS OF THE INVENTION

It is, therefore, a main object of the present invention to provide panels which are interengageable by a self-interlocking standing seam.

It is another object of the present invention to provide a panel standing seam requiring no machinery to effect the interlocking of adjoining panels.

It is a further object of the present invention to provide means for interlocking adjoining panels which does not require any fasteners to effect the interlocking.

It is yet another object of the present invention to provide panels which can be mounted on a building structure using fasteners which are hidden from view.

It is yet a further object of the present invention to provide building panels having no holes through exposed panels.

It is still another object of the present invention to provide building panels which are easily nested together.

It is still a further object of the present invention to provide building panels which have a continuous uninterrupted full-length seam.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
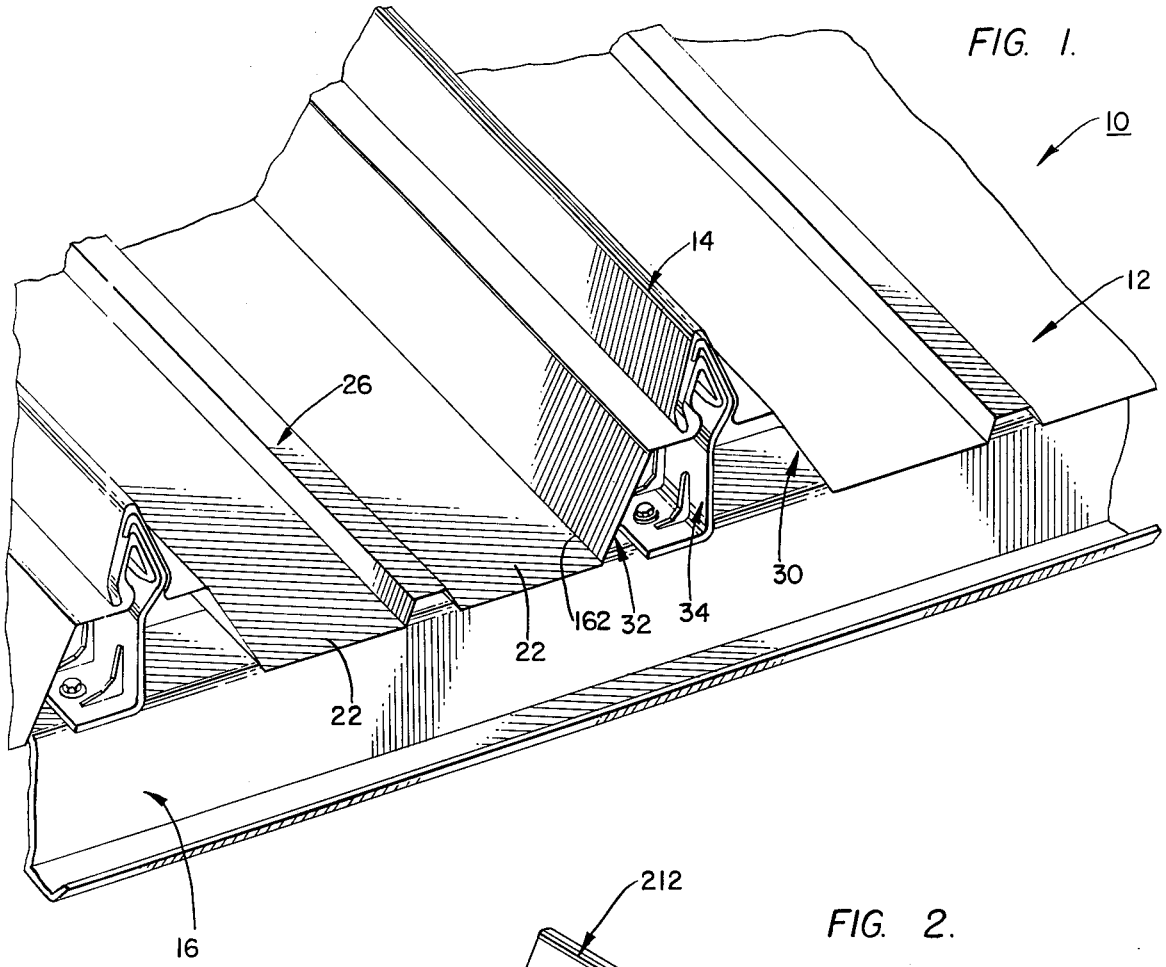
FIG. 1 is a perspective of a roof embodying the teachings of the present invention.

Shown in FIG. 1 is a roof 10 comprising a plurality of panels 12 coupled together using a seam 14 embodying the teachings of the present invention. The roof panels in FIG. 1 are mounted on purlins 16 to form the roof 10.

Each panel has a central section comprising a plurality of planar sections 22 integrally connected together by a longitudinal rib 26 and each terminating in one of a pair of lateral side edges 30 and 32.

Figure 3:
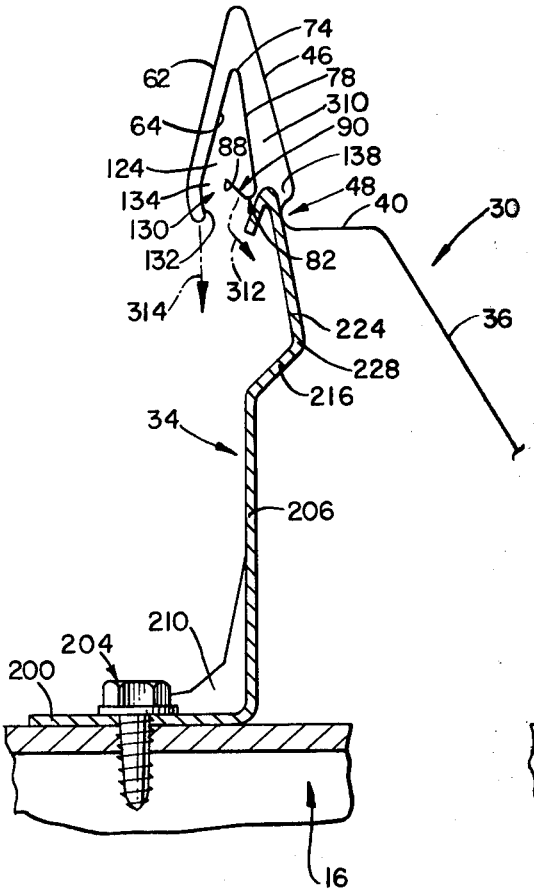
FIGS. 3–5 are elevation views showing the joining and interlocking of adjacent panels in accordance with the teachings of the present invention.
Figure 4:
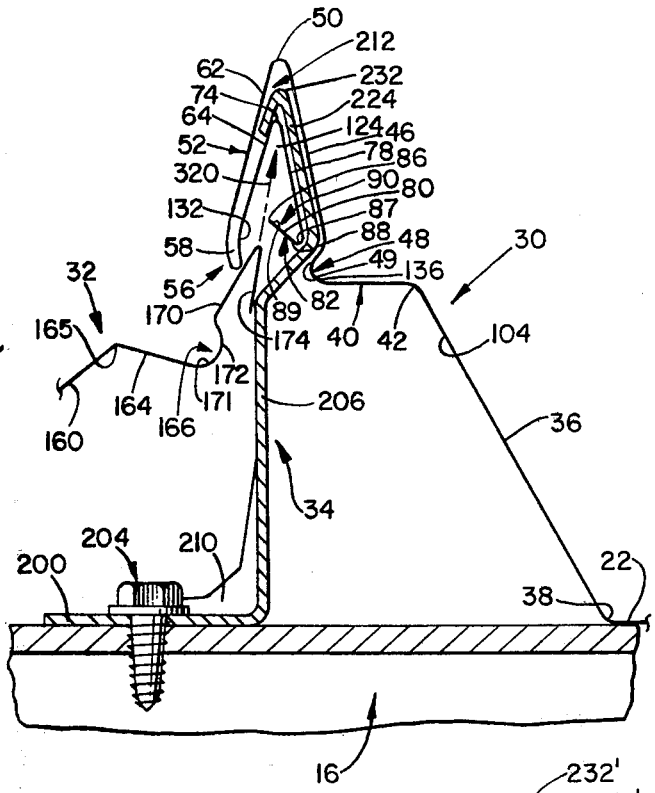
Figure 5:
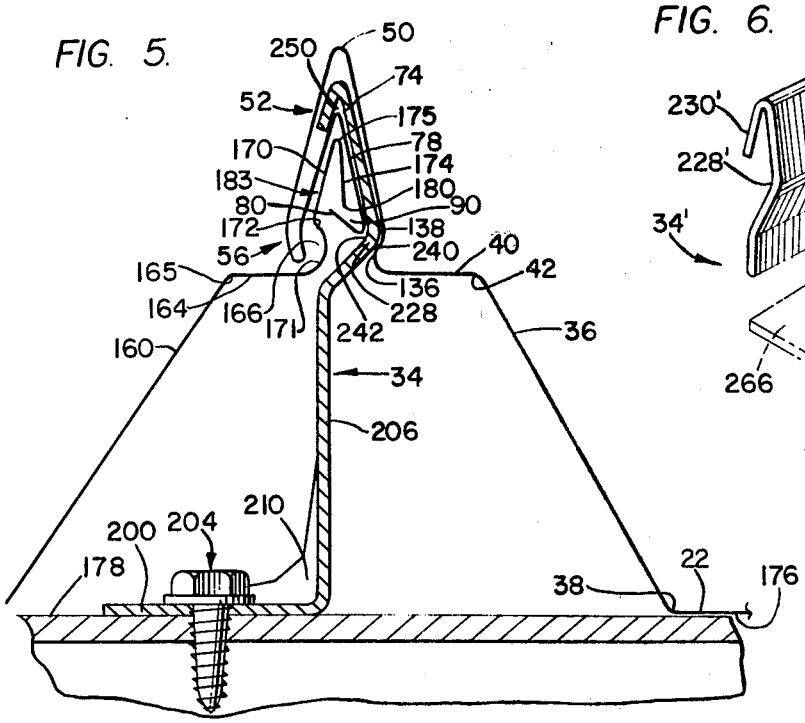

The panels are interconnected at the lateral edges thereof to form either a roof 10 or a side wall, and the preferred form of the interconnection is best shown in FIGS. 3–5.

The lateral edges of adjacent panels are locked together to form the engageable members of the roof or side wall. The adjacent panels form a pair of engageable members and the lateral edge 30 of one of those engageable members forms a female element and the lateral edge 32 of the other member forms a male element. A gripping element 34 is interposed between the interengaged male and female elements and is connected to purlin 16 to connect the roof panels to that purlin. As shown in FIG. 4, the lateral edge 30 includes an elongate planar riser portion 36 integrally connected at one lateral edge thereof to planar section 22 to form a first angular corner 38 and at the other lateral edge thereof to an elongate, horizontally extending planar portion 40 to form a second angular corner 42. The portion 40 extends horizontally to be in spaced parallelism with the planar portions 22 and to be spaced apart therefrom by portion 36 when the panels are set up. An elongate planar portion 46 is integrally connected to portion 40 along one lateral edge thereof at an arcuate corner 48 and is upwardly inclined therefrom. An elongate arcuate section 49 is connected at one lateral edge to portion 40 and at the other lateral edge to portion 46 to form arcuate corner 48. The portion 46 has a top corner 50 along the other lateral edge thereof which has an elongate, outwardly declining skirt 52 integrally connected thereto. The skirt angles outwardly of the lateral edge 30 and downwardly from the top, and the other lateral edge of the skirt is free and forms lower terminal end 56. The skirt extends longitudinally of the panel 20 and is coextensive therewith.

In the preferred embodiment, the terminal end 56 has a lip 58 thereon. The skirt has an outer face 62 and an inner face 64 integrally connected together at one end of each at the lower terminal end 56.

The inner face 64 terminates in a concave corner 74 which is located subadjacent top corner 50 and is rounded to be downwardly open and has face 64 tangentially and integrally joined thereto. An elongate planar interior face section 78 is tangentially and integrally joined to the corner 74 along one lateral edge of that face and declines downwardly therefrom.

Tangentially and integrally joined to the other, or lower, lateral edge of face 78 is a planar portion 80 of a hook edge 82. The planar portion 80 is lateral edge-connected at a lower edge thereof to a lower edge of the planar portion 78 and is upwardly inclined therefrom. The other lateral edge 86 of the hook edge is free. A corner 87 is formed at the connection of portions 78 and 80 and has an outer surface 88 and an inner surface 89. The hook-edge defining portions 78 and 80 are upwardly divergent from corner 87 to form a "V" shape having a chamber 90 defined therebetween. The function of chamber 90 will be discussed below.

The skirt inner face 64 is spaced apart from face 78 and is upwardly convergent therewith. The face 64, corner 74 and face 78 define an open cavity 124 which is in the shape of an inverted V. A cavity mouth 130 is formed between outer hook edge surface 88 and inner surface 132 of the lip 56, and has a throat section 134 formed between the free edge 86 of the hook and the interior face 132 of the lip 58. Arcuate corner 48 has inner surface 136 which forms one surface of an internal pocket having a function which will be explained below. The portion 78 and corner 74 along with the hooking edge 82 thus form a channel located beneath skirt 52.

As best shown in FIG. 4, lateral edge 32 of each of the panels 20 interfits with lateral edge 30 of an adjoining panel and includes an elongate planar upwardly slanting portion 160 integrally joined at a lower lateral edge thereof to planar section 22 by an angular corner 162 (FIG. 1). Another elongate planar portion 164 is integrally connected to the upwardly slanting portion by another corner 165 which connects an upper lateral edge of the first slanting portion to a lateral edge of the second slanting portion.

As shown in FIG. 5, planar portion 164 is essentially horizontal and in spaced parallelism with the portions 22 when the panels are joined. An arcuate corner 166 is formed on another edge of the planar portion 164, and an upwardly directed planar portion 170 is connected to planar portion 164 by the corner 166. The arcuate corner 166 is formed by a curved segment having an inner surface 171 and an outer surface 172. A further planar portion 174 is connected to portion 170 by a corner 175 to form an inverted "V" shape. As shown in FIG. 5, the inclination of portions 170 and 174 correspond to that of the "V" formed by the skirt face 64 and face 78 when the panels are joined. The width of the slanting portion 160 as measured between corners 162 and 165 is selected so that terminal end 56 is located adjacent inner surface 171 of arcuate corner 166 when lower surfaces 176 of both adjoining panels are flushly mounted on upper surface 178 of the purlin.

A lip is formed by free edge 180 of the planar portion 174 and is located to be received in chamber 90 defined by upwardly diverging portions 80 and 78 as shown in FIG. 5 to be locked therein.

The tip 56 is received in the arcuate corner 166 and serves, along with the entrapment of the tip 180 in chamber 90, to maintain adjoining panels interlocked, once those panels are assembled.

A hook 183 is therefore defined by planar portion 170, corner 175 and slanting portion 174. The hook 183 forms an elongate extension on the male locking element which is received in the channel defined on the female locking element.

The panels are preferably formed of a metal-like material and the thickness of skirt sections 62 and 64 relative to each other, and the angle of declination of the skirt with respect to the vertical is selected so that the skirt is properly spaced with respect to the hook edge and has a suitable resiliency. The skirt serves to hold the male element locked in the female element after interengagement of two adjacent panels, but must be sufficiently yieldable to permit the male element to be expeditiously inserted into the female element. The skirt also serves to cover the coupling once made to protect that coupling from dirt or other environmental factors which may detrimentally affect that coupling in some manner.

Figure 2:
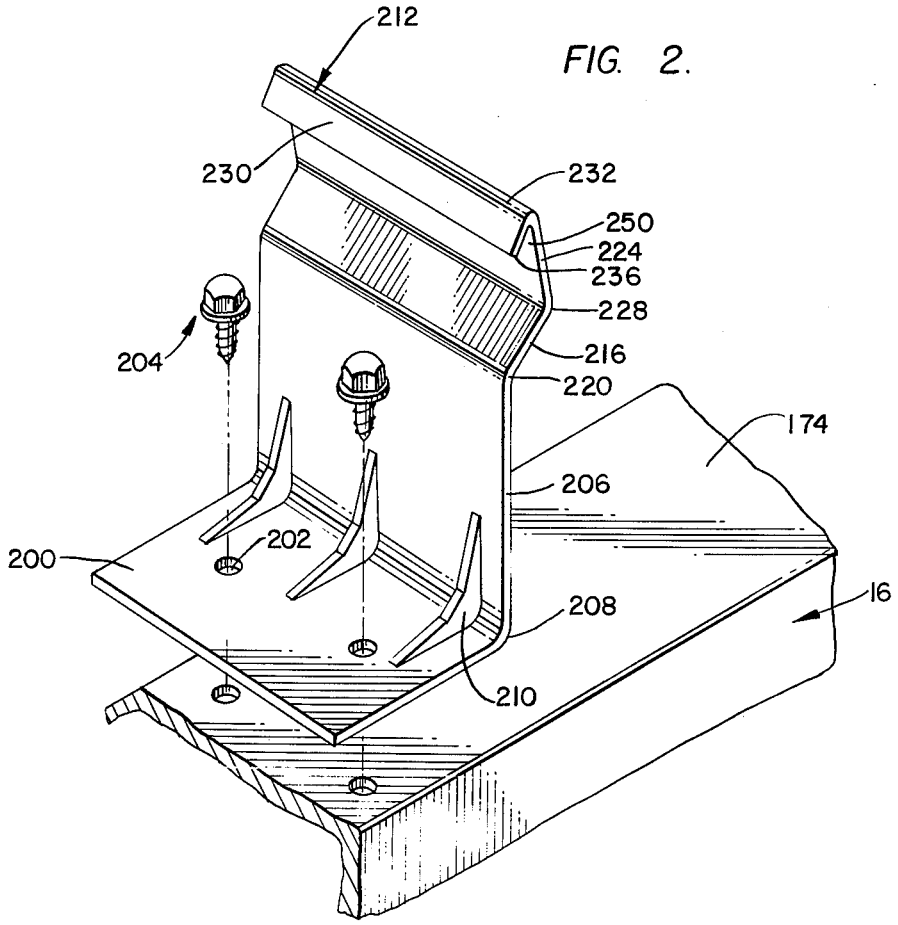
FIG. 2 is a perspective of a gripping element used in the roof embodying the teachings of the present invention.

The gripping element 34 is shown in FIG. 2 and includes a base 200 which has a plurality of fastener-receiving holes 202 defined therethrough and which is coupled to a purlin by fasteners, such as self-taping metal screws 204. The base is horizontally oriented to flushly fit on purlin upper surface 174 and has a vertical section 206 integrally connected thereto by a rounded corner 208. Fillets 210 serve to reinforce the element. A hooking element 212 is integrally connected to the section 206 at an upper end thereof and comprises an upwardly inclined elongate planar section 216 integrally attached to the section 206 by a corner 220, and a further upwardly inclined elongate planar section 224 integrally connected to an upper edge of the section 216 by a corner 228. A lip 230 is integrally attached to the section 224 by a corner 232 to depend therefrom. The lip 230 forms an inverted "V" with the section 224 and has a free edge 236 thereon.

As shown in FIG. 5, corner 228 is received in pocket 138 with outer surface 240 thereof abutting inner surface 136 of the pocket. The hook edge 82 is located superadjacent inner surface 242 of the corner 228, and pocket 250 formed between lip 230 and section 224 receives corner 74 therein. As shown in FIG. 5, the slope of the verging sections 64 and 78 approximates that of verging sections 224 and 230 so that corner 175 is received in corner 232 in a locking engagememt.

The gripping element 34 therefore has corners 228 and 232 which each form a male fastener element on the outside thereof and a female fastener element on the inside thereof formed by lip 230 and section 224. The gripping element is therefore hermaphroditic and interlocks with both panels and further assists the interlocking engagement of those panels while attaching the interlocked panels in a building structure element.

Figure 6:
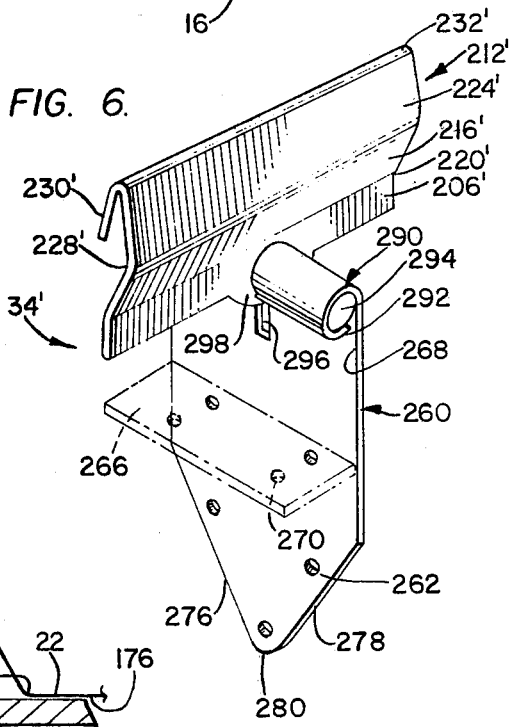
FIG. 6 is a perspective of an alternative embodiment of a gripping element.

An alternative embodiment of the gripping element is shown in FIG. 6 and indicated generally by the numeral 34'. The gripping element 34' includes a pentagonal base 260 having a plurality of fastener-receiving holes 262 defined therethrough. An elongate mounting flange 266 is attached at one lateral edge thereof to a face 268 of the base and extends outwardly therefrom. The flange has a plurality of fastener-receiving holes 270 defined therein to be longitudinally aligned with the base and to be transverse of the holes 262. Non-parallel sides 276 and 278 converge at corner 280 to form a downwardly directed vertex, and a hooking element 212' is pivotally attached at the other, or top, end of the base.

A hinge-like connection 290 includes a keeper 292 integrally attached to the base 260 and a stub shaft 294 rotatably received in the keeper to be coaxial therewith. The hermaphroditic hooking element 212' has a lower planar section 206' integrally connected to an upwardly inclined section 216' by a corner 220'. A further elongate upwardly inclined section 224' is integrally connected at one edge to one edge of the section 224' by corner 228' and at the other edge to lip 230' by a corner 232'. The hooking element 212' of the alternative embodiment is similar to the hooking element 212 of the FIG. 2 preferred embodiment with the exception of the truncated nature of the planar section 206'.

The FIG. 6 hooking element planar section 206' has a hole defined therethrough which encircles the keeper 292. An elongate slot 296 is defined in base 260 adjacent keeper 292, and apron 298 which contains the keeper-receiving hole of the hooking element 212' fits through the slot 296.

The base 260 and/or flange 266 is attached to a purlin, and the FIG. 6 hermaphroditic hooking element 212' operates the same way as does the preferred form of the gripping element.

The large radii used in the corners of the panel locking elements allows the panels to be constructed of material having a yield strength much higher than that of prior art panels. Thus, panels utilizing the seam of the present invention are much stronger than prior art panels.

As seen in FIG. 5, the fasteners are hidden from view once the panels are assembled and thus do not detract from the outward appearance of the panels. A further result of these hidden fasteners is that there are no holes through exposed portions of the panels.

To join two engageable panels together, the gripping element 34 is suitably secured to a building structural element using fasteners, such as screws 204. The female edge of a panel is tilted with respect to the secured gripping element as shown in FIG. 3 so that the hermaphroditic portion of the gripping element is forced through the opening defined between hook edge 82 and surface 89 of arcuate corner 48 and into the pocket 138. The female element of the unsecured panel is forced downwardly onto the gripping element until the hermaphroditic portion is fully inserted into passage 310 defined between portions 78 and 46 as shown in FIG. 4. The movement of the hook edge 82 and of the panel onto the gripping element is indicated in FIG. 3 by arrows 312 and 314, respectively. With the gripping element 212 moving through passage 310, the female element cavity 250 is moved into position to receive corner 74 therein. The just interlocked panel is then positioned as shown in FIG. 6. The male edge 32 of the next panel is interlocked with the just-locked panel by tilting the panel as indicated in FIG. 4, and forcing the hook 183 upwardly into the cavity mouth 130 and throat 134 and cavity 124 as indicated by arrow 320 in FIG. 4 until upper corner 175 of the male element is located subadjacent corner 74 of the female element as shown in FIG. 5. The just-interlocked panel is then positioned as shown in FIG. 5. The process is repeated until the roof or side wall is desirably covered. The natural resiliency of the skirt enables that skirt to move to allow the male element to wedge through the throat and into the cavity 124 and into interlocking engagement with the edge 30 as shown in FIGS. 3–5.

The panels are thus self-interlocking and require no special on-site equipment to effect that interlocking and can be interlocked by hand. The panels need only be oriented with respect to a fastened gripping element, then interengaged therewith and with each other. The locking is automatic and secure, thus expediting erection of the building. The male and female panel elements are thus fastened together by a snapped-in gripping action, and the seam formed thereby is uninterrupted and continuous. The gripping element is inserted behind and above the female insertion area so the gripping action occurs above the seam. There are two thicknesses of material on either side of the panel male edge to produce a variety of advantages.

In the preferred embodiment, the materials are 22 gauge, 24 gauge, and 26 gauge galvanized, pre-painted steel; or 0.032 aluminum or 0.040 aluminum.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bound of the claims or that form their functional as well as conjointly cooperative equivalents are, therefore, intended to be embraced by those claims.

We claim:

1. A pair of elongate roof panel members comprising:

a male element on a longitudinal side edge of one member, said male element including a "V" shaped extension member which opens toward a roof on which said one member is mounted and has one leg thereof being connected to the one member, and the other leg thereof having an edge defining portion thereon and being connected to said one leg by an apex forming corner;

a female element on an opposing edge of said other panel member including a first channel defining portion on one longitudinal side edge thereof defining a part of a channel which opens toward a roof on which said other panel member is mounted, said other member further including a double wall skirt member having one wall thereof connected to said first channel defining portion so that said skirt extends outwardly of said first channel defining portion and toward the roof on which said other panel member is mounted, said skirt having an end portion with the other wall thereof connected to said one wall at said end portion, said other member further including first and second planar portions and an arcuate corner connecting said planar portions together, one of said first and second planar portions being connected to the one wall of said double wall skirt member, the other member further including a third planar portion attached at one edge thereof to the other wall of said skirt member at a location remote from said skirt end portion and a fourth planar portion attached to another edge of said third planar portion to extend toward said skirt so that said third and fourth planar portions define a hook edge located between said skirt and said first planar portion adjacent said arcuate corner with said skirt covering said third planar portion and said hook edge;

said male "V" shaped extension member being wedged between said skirt and said hook edge with said edge defining portion being captured by said hook edge with said male element extension member other leg being located adjacent said third planar portion to lock the panel members together; and a gripping element attached to a building and having a gripping element planar section located between said first and said third planar portions and a hooking element attached to said gripping element planar section and receiving said third planar portion skirt attaching edge therein.

2. The engageable members of claim 1, wherein said gripping member hooking element includes a depending lip which fits over one edge of said channel element.

3. The engageable members of claim 2, wherein said gripping member hooking element further includes a pair of planar sections angularly joined together to form a corner which is received in a pocket defined in said female element.

4. A panel comprising:

an elongate central section having a pair of lateral edges;

a male locking element on one lateral edge including a first slanting portion connected to said central section, a horizontal portion, an arcuate corner connected to said horizontal portion, a second slanting portion connected to said arcuate corner, a lip forming flange connected to said second slanting portion by a corner which is curved so that said flange and said second slanting portion form an inverted V, said lip forming flange having a free terminal end;

a female locking element on the other lateral edge of said central section, said female locking element including a first rising portion connected to said central section, a horizontal planar portion connected to said rising portion, a pocket forming arcuate portion, a second slanting portion connected to said arcuate portion, a skirt portion connected to said second slanting portion by a top corner to depend outwardly and downwardly therefrom, a channel defining portion connected to said skirt by a rounded corner which is located beneath said top corner, said channel defining portion including a slanting wall portion connected to said rounded corner and depending therefrom, and a hook forming member connected to said slanting wall portion to be located beneath said skirt and adjacent said pocket forming arcuate portion, said channel defining portion defining a channel located beneath said skirt and sized to receive said lip forming flange and trap said free terminal end thereof behind said hook forming member;

a male member of one panel being wedgingly interlocked in a female member of an adjoining panel; and an elongate gripping element having a base fastened at one end to a building structure and having at the other end a hooking element which includes a first slanting section connected to said base and being upwardly inclined therefrom, a second slanting section connected to said first slanting section and being upwardly inclined therefrom, and a lip forming section connected to said second slanting section to depend therefrom, said lip forming section and said second slanting section forming an inverted V and being disposed with respect to each other to receive said female element channel portion rounded corner therebetween.

5. The panel of claim 4, wherein said skirt forming member has a pair of slanting walls connected together so that there are at least two layers of material located on each side of said male locking element slanting portions.

6. The panel of claim 4, wherein said gripping element base and hooking elements are angularly disposed with respect to each other and said base includes a keeper attaching said hooking element to said base.

7. The panel of claim 6, wherein said gripping element base is elongate and further includes a flange attached to said base between the end edges thereof.

8. The panel of claim 4, wherein said gripping element hooking element is pivotally connected to said base.

9. A panel comprising:

an elongate central section having a pair of lateral edges;

a male locking element on one lateral edge, said male element including a "V" shaped extension member which opens toward a roof on which the panel is mounted and has one leg thereof being connected to said central section, the other leg of said "V" having an edge defining portion thereon and being connected to said one leg by an apex forming corner;

a female element on another lateral edge of the panel member including a first channel defining portion on one longitudinal side edge thereof defining a channel which opens toward a roof on which the panel member is mounted, said female element further including a double wall skirt member having one wall thereof connected to said first channel defining portion so that said skirt extends outwardly of said first channel defining portion and toward the roof on which the panel member is mounted, said skirt having an end portion with the other wall thereof connected to said one wall at said end portion, said another lateral edge further including first and second planar portions and an arcuate corner connecting said planar portions together, the another lateral edge further including a third planar portion attached at one edge thereof to the other wall of said skirt member at a location remote from said skirt end portion and a fourth planar portion attached to another edge of said third planar portion to extend toward said skirt so that said third and fourth planar portions define a hook edge located between said skirt and said first planar portion adjacent said arcuate corner with said skirt covering said third planar portion and said hook edge;

said male "V" shaped extension member and said female member each being positioned on the panel so that said male member cooperates with said female member, said male member being wedged between said skirt and said hook edge with said edge defining portion being captured by said hook edge when a male element extension member other leg of one panel is located adjacent said third planar portion of an adjoining panel to lock the panels together; and a gripping element attached to a building and having a gripping element planar section located adjacent said third planar portion and a hooking element attached to said gripping element planar section and receiving said third planar portion skirt attaching edge therein.

* * * * *